US006887121B2

(12) United States Patent
Whitehead

(10) Patent No.: US 6,887,121 B2
(45) Date of Patent: May 3, 2005

(54) TOY

(75) Inventor: Brian Whitehead, London (GB)

(73) Assignee: Origin Products, Inc., London (GB)

( * ) Notice: Subject to any disclaimer, the term of this patent is extended or adjusted under 35 U.S.C. 154(b) by 0 days.

(21) Appl. No.: 10/272,091

(22) Filed: Oct. 16, 2002

(65) Prior Publication Data

US 2003/0228825 A1 Dec. 11, 2003

(30) Foreign Application Priority Data

Jun. 11, 2002 (GB) ..... 0213339
Aug. 21, 2002 (GB) ..... 0219453

(51) Int. Cl.[7] ..... A63H 33/26
(52) U.S. Cl. ..... 446/129; 446/136; 446/139
(58) Field of Search ..... 446/129, 131, 446/135, 136, 139, 337; 40/411, 415, 426

(56) References Cited

U.S. PATENT DOCUMENTS 2,767,517 A * 10/1956 Hooper
2,814,909 A * 12/1957 Knowles
3,532,341 A * 10/1970 Shaw
3,603,004 A * 9/1971 Fink
3,946,520 A * 3/1976 Goldfarb et al.
4,169,336 A * 10/1979 Kuhn
4,236,347 A * 12/1980 Fauls
4,683,669 A * 8/1987 Greer, Jr. ..... 40/414
5,713,776 A * 2/1998 Hou ..... 446/136
6,102,767 A * 8/2000 Wiggs et al. ..... 446/135
6,132,284 A * 10/2000 Lin ..... 446/267
6,544,094 B1 * 4/2003 Maddocks et al. ..... 446/175
6,547,625 B2 * 4/2003 Whitehead ..... 446/132

* cited by examiner

*Primary Examiner*—Derris H. Banks
*Assistant Examiner*—Ali Abdelwahed
(74) *Attorney, Agent, or Firm*—Woodard, Emhardt, Moriarty, McNett & Henry LLP

(57) ABSTRACT

The invention relates to the provision of the toy. The toy comprising at least one article, a play area and, in certain embodiments, a movement device. The play area can be formed with a magnetically attractive base and walls or portions of the same can be so formed. The article is formed with magnetically attractive material, typically magnets, at spaced locations and the article is formed of flexible material such that movement of the magnets by a magnetic moving force cause flexing and movement of parts of the article. The article can depict, in a model form, an animate character such as a human or animal and the movement allowed by the flexible material improves the realism of the same.

21 Claims, 6 Drawing Sheets

TOY

This invention relates to a toy and particularly to a toy comprising one or more articles for location and movement on or about a play area.

It is known to provide toys comprising at least one article provided for movement on or about a model play area. Conventionally the articles have magnets located therein which are magnetically attracted to other magnetically attractive material such as that located in movement means located underneath or behind a surface of the play area or in other objects. A user is able to manipulate the movement means to cause movement of the magnet associated therewith. This movement results in movement of the magnet in the article, and hence the article. The article, typically in the form of a human model, is normally composed of a plurality of rigid body components interconnected by means, such as adhesive, pins, joints and/or the like. A problem associated with this type of doll is that movement of a magnet located in one of the body components typically results in uniform movement of that body component only, or alternatively unitary movement of all of the body components as a single item. In whichever embodiment this provides the appearance of stiff and non life like movement of the doll, thereby making the doll unrealistic and limiting the enjoyment of the toy to the user. In addition, the assembly of the various body components of the doll can often be complex, time consuming and expensive. The play area used in conjunction with the model typically depicts a particular environment such as a house, garden or the like.

It is therefore an aim of the present invention to provide a toy which is more realistic in use when moving or being moved and is relatively easy to manufacture and assemble. A further aim of the present invention is to provide further improvements to the provision of the play area with magnetic attraction between the at least one article and the play area.

According to a first aspect of the present invention there is provided a toy including; one or more articles for location in and movement around a play area, said article having magnetically attractive means provided therein; movement means having further magnetically attractive means such that actuation of said movement means or article in the vicinity of the other exerts a moving force on said other caused by magnetic attraction between said article magnetically attractive means and said further magnetically attractive means and wherein said article is formed at least partially from a substantially flexible material such that the moving force exerted on the article causes at least a part of said article to flex and move in response to the moving force.

In one embodiment the entire article is manufactured from, the flexible material. Alternatively the article is provided with an outer skin of the flexible material.

Typically, the flexing movement of the article is over a sufficient proportion of the article such that the entire article appears to be affected by the movement. Typically the article is provided in one piece such that the movement of the same provides to the user, typically a child, a more realistic and life like series of movements, thereby providing greater enjoyment. For example, the article can twist, bend, stretch or a combination of the same to provide a wider range of movements than is possible with the conventional toys/articles with rigid components and which are actuated by magnetic control means.

Preferably the moving force exerted on said article causes the greatest degree of movement in a first portion of said article which is adjacent the location of a magnet in the same. This adjacent movement results in movement in at least a second portion of the article, due to the ability of the material to flex.

In one embodiment, the movement can comprise any or be a combination of the movement components of rotation or extension and contraction in size during movement of the movement means. Preferably the material used is sufficiently resilient to ensure that the article returns to the original dimensions and configuration once the moving force has been removed.

In one embodiment, the magnetically attractive means is one or more magnets with the other magnetically attractive means being a further magnet or magnetically attractive material.

Preferably the flexible material has a shore hardness in the range of 20–40.

In a preferred embodiment the flexible material has a shore hardness value in the range of 25–30.

In one embodiment the toy article is in the form of any or any combination of a person, animal, robot, cartoon character, fictitious creature and/or the like.

Preferably the play area includes one or more objects located thereon with which the one or more articles are capable of interacting therewith, due to magnetic attraction between the article and object.

Preferably the objects have movement means by which the objects can be moved relative to the play area. Actuation of the movement means typically results in rotational and/or lateral movement of the objects on the play area.

Preferably the said objects are made from or include magnetically attractive material and the magnetic means provided in the article is attracted to the object, thereby allowing interaction between the object and the article. For example, movement of the object via actuation of a movement means operated by a user results in movement of the article, as well as the object, such as for example, the article moving in conjunction with the movement of an iron along an ironing board.

In one embodiment, the attraction between the magnetically attractive means in the article and the magnetically attractive means, such as metal, of the object, provides the article with stability and prevents the article from toppling over and/or allows positioning of the article.

In a further embodiment the play area is made from metal or contains magnetic material therein. The magnetically attractive means in the article are attracted to the play area surface, thereby securing the article in a particular position on the play area.

In one embodiment movement means are provided on the underside of the play area and include one or more arms to which further magnetic means are attached. A user is able to manipulate the movement means, thereby moving the further magnetic means relative to the underside of the play area. Movement of the further magnetic means results in movement of magnetically attractive means on the play area such as the flexible article containing magnetically attractive means.

Typically the movement means are moved laterally by a user to provide a variety of movements of the one or more article on the play area.

In one embodiment each arm is slidable relative to one or more other arms. Movement of the one or more arms is effected by any or any combination of manual, clockwork or electrical means.

In one embodiment the movement means under the play area are slidably movable with respect to the play area to allow the movement of the article along a play area surface, following the path of the movement means and thereby, in conjunction with the movement of the flexible article itself as herein described, giving the impression of the article walking across the play area surface.

According to a second aspect of the present invention there is provided a toy model article, said article having magnetically attractive means provided therein, said article provided for selective actuation via movement means having further magnetically attractive means and arrangeable by the user with respect to a play area for the article such that actuation of said movement means exerts a moving force on said article caused by magnetic interaction and wherein at least a portion of the said article is formed from a substantially flexible material, said portion having an at rest configuration and a movement configuration when acted on by the magnetic interaction between the article and movement means such that the moving force exerted on said article cause the flexible portion of said article to move and when the moving force is removed the flexible means resiliently returns to the at rest configuration.

In one embodiment the article is manufactured as a one-piece item from the flexible material with magnets positioned in cavities in the material or alternatively embedded in the material during forming of the article.

In an alternative embodiment the article is provided with a core which can be formed from one or a number of components, said core enclosed by an outer skin, said outer skin formed of a flexible material.

In a further aspect of the invention there is provided a toy article, said article provided for movement via movement means which can be positionable and/or controlled with respect to a play area by a child to exert a moving force on the article and wherein at least a portion of the article is formed from a styrenic block copolymer material.

In one embodiment the material includes blocks of rubber and styrene.

In one embodiment the material used is that sold under the Registered Trade Mark KRATON.

In a further aspect of the invention there is provided a toy, said toy including a play area and at least one article including at least a portion which is formed of flexible material for selective positioning with respect to the play area, said play area defined by walls and/or a base and wherein at least portions of the walls and/or base are formed from magnetically attractive material to which magnets mounted in the article are attracted so as to allow the selective location and retention of the article with respect to said portions of the play area.

In one embodiment, all of the available walls and/or base of the play area are formed of the magnetically attractive material. In one embodiment, the magnetically attractive material is provided of a sheet form and may be hidden from view by other decorative sheet material or objects positioned so that the user, typically a child, is not aware of the provision of the magnetically attractive material in the wall and/or base.

In one embodiment, if the magnetically attractive material is provide in portions of the base and/or walls then the position of the same with respect to the whole play area can be indicated by signs or other decorative means of distinguishing the same so that the child is aware of the positions on the play area at which the article can be positioned.

Particularly in this embodiment, movement means for the article need not be provided and instead the user can physically manipulate the article.

In one embodiment, magnets are provided at the locations of the flexible portions of the article. This allows, in addition to the positioning of the article on the play area, the article to "interact" with other objects which can also be magnetically retained in position on the play area. In one embodiment the article includes magnets mounted at spaced locations and each of said magnets can be located at spaced positions on the play area walls and/or base with the flexibility of the article ensuring that the article flexes to take up the desired position and pose determined by the selective positioning of the magnet containing portions of the article in the play area.

In a further embodiment, a plurality of objects are provided as part of the toy, said objects depicting any, or any combination of, animals, humans, items of furniture, trees or other inanimate objects and typically each of said objects is provided with at least one magnet therein so as to allow the objects to be selectively positioned by the child in the play area and in particular, to those parts of the play area which include magnetically attractive material. Thus, the child can then position the objects as they wish to create a particular play environment which may, for example, depict a house with a series of play areas, each play area depicting a particular room of the house and it will be appreciated that there are a range of play environments that can be created.

The advantages of the present invention are that the objects can be provided in conjunction with a flexible article or articles to undergo more "life like" movements compared to the movements provided by prior art toys. This is typically achieved by the article of the present invention not requiring mechanical joints between body components due to the flexibility of the same. As such, there are no joints visible to the user which might detract from the realism of the toy. In addition, there is no or only minimal requirement for complicated and time consuming assembly of the article due to the article being moulded from the flexible material. Furthermore, the flexibility of the article and the ability of the article to bend allows the article to undergo a range of multi-directional movements and also to effectively and realistically interact with other objects and/or the play area itself.

Embodiments of the present invention will now be described with reference to the following figures, wherein.

Figure 1:
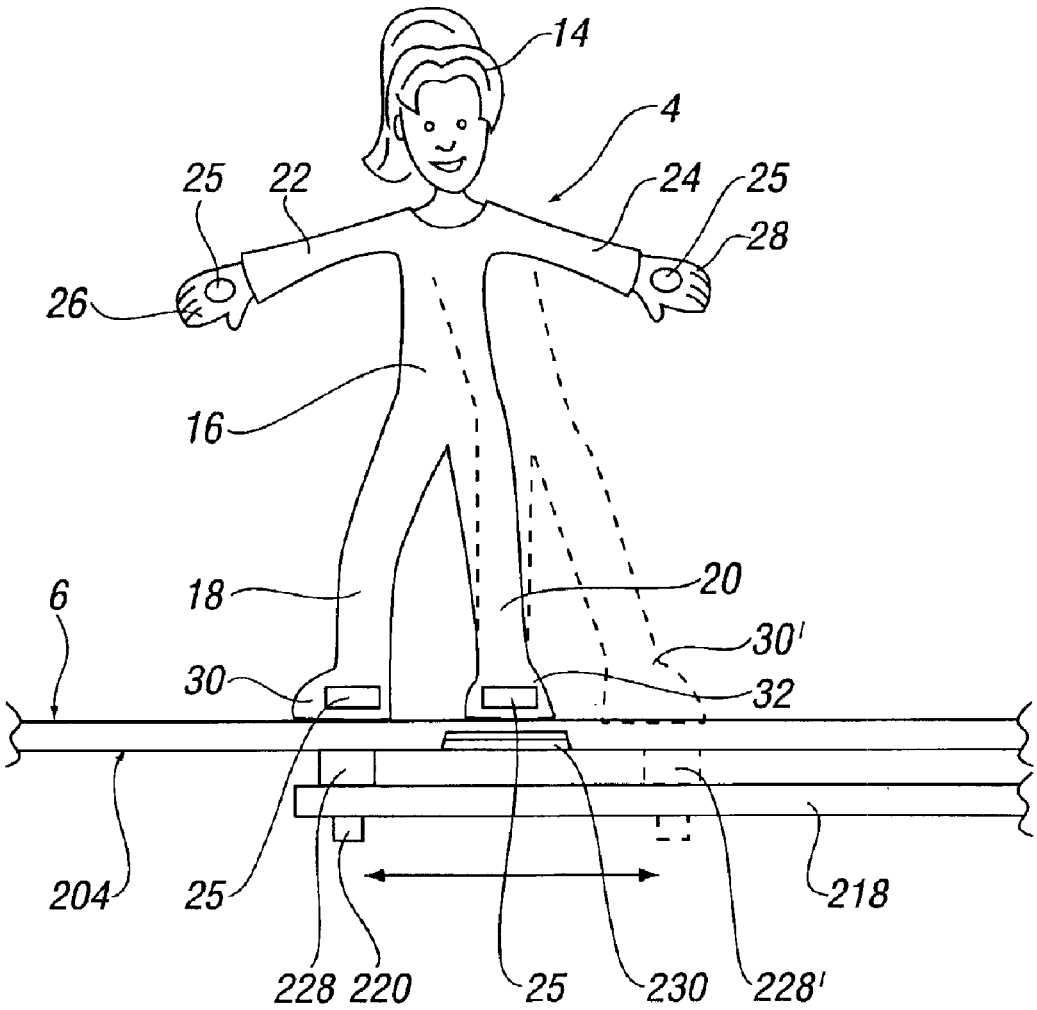
FIG. 1 is an example of an article in the form of a doll on a playbase according to an embodiment of the present invention.
Figure 2:
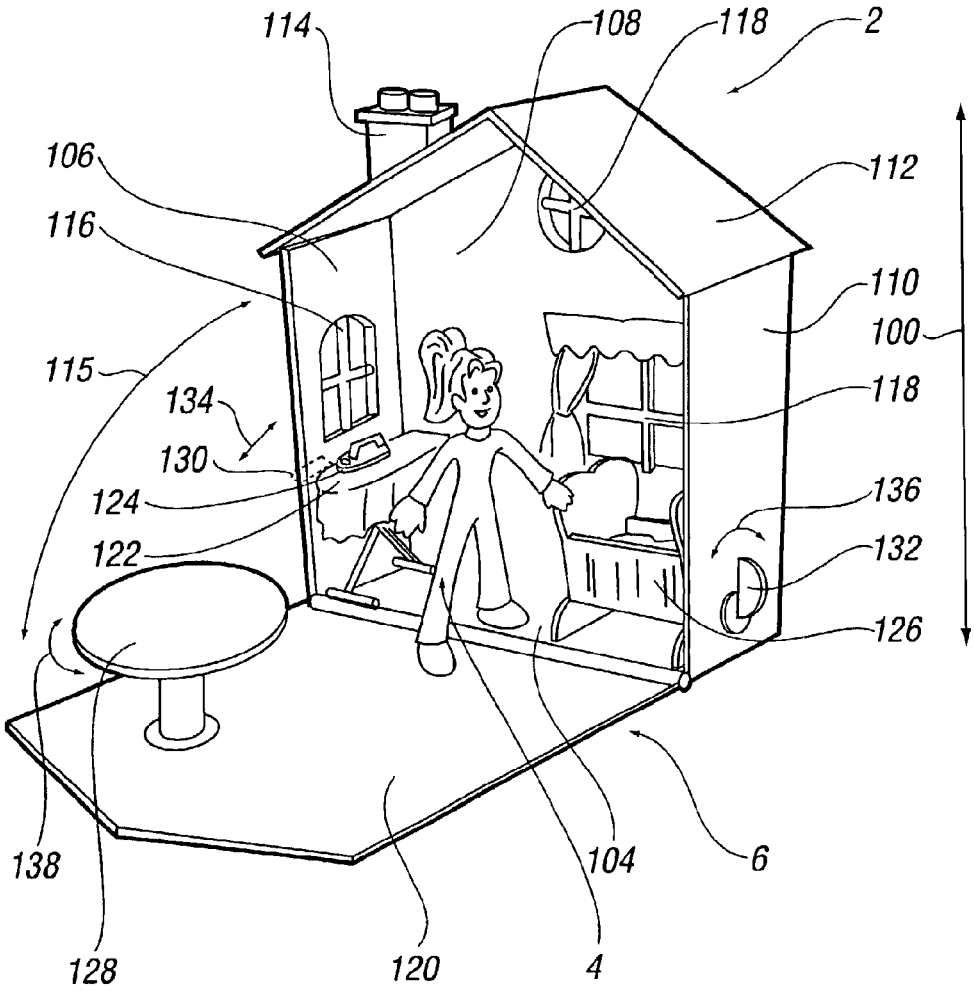
FIG. 2 is an example of a play area according to one embodiment of the present invention.
Figure 3:
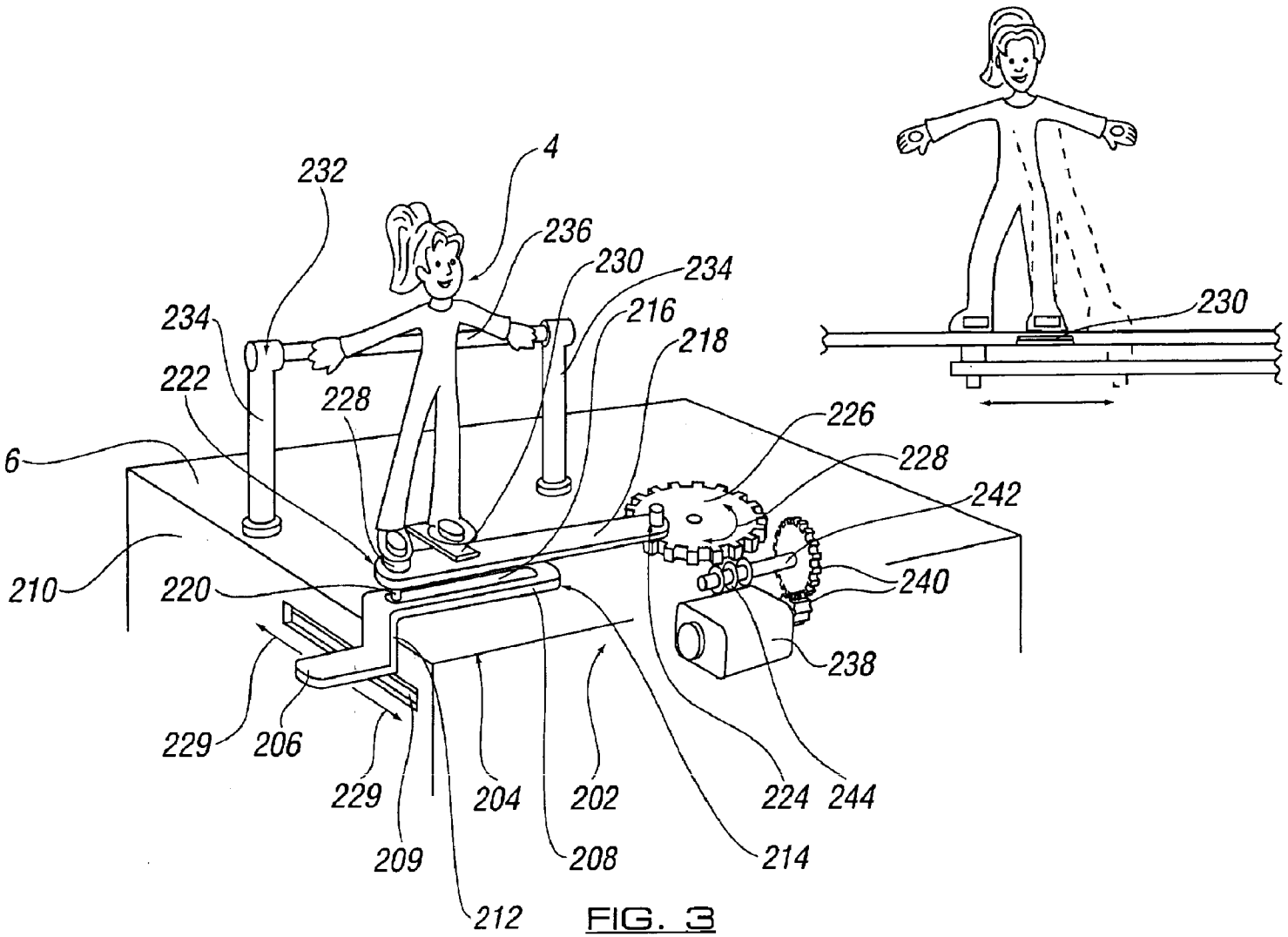
FIG. 3 illustrates an example of movement means used according to an embodiment of the present invention.

Referring to the FIGS. 1–3, there is illustrated a toy 2 comprising an article in the form of a doll 4 located on a playbase 6.

The doll 4 has head 14, body 16, legs 18, 20 and arms 22 24 components. Magnets (shown by dotted lines) 25 are provided in the hands areas 26, 28 and feet areas 30, 32, and are typically hidden from view.

Referring to FIG. 3, a first embodiment of the invention is shown in which the play area is provided with movement means 202 located on the underside 204 of the play area surface 6. The movement means includes a user actuation portion/handle 206 at one end of an arm 208. The user actuation portion 206 protrudes through a slot 209 formed in a side 210 of the play area 6 to allow a user to grip the handle during use.

A shoulder portion 212 is provided between the user actuation portion 206 and the opposite end 214 of the arm 208, thereby allowing the end 214 of the arm to be located adjacent the underside surface 204 of the play area.

The end 214 of arm 208 is provided with an elongate slot 216 therein. A further arm 218 is provided between arm 208 and the underside surface 204 of the playbase. A protrusion peg 220 is provided on the base of arm 218 at an end 222 and is slidable in slot 216. The other end 224 of arm 218 is joined to a rotatable cog 226 also located on the underside 204 of the playbase 6.

A magnet 228 is fixed to the upper surface of arm 218 at end 222. The magnet 228 is attracted to magnet 25 in foot 30 of doll 4 located on the top surface of the play area 6. The upper surface of magnet 228 and lower surface of magnet 25 are of opposite polarity and the magnetic attraction therebetween is such that movement of magnet 228 on the underside of the playbase is sufficient to cause movement of magnet 25 and thus movement of foot 30 on the upper surface of the playbase.

In use, a user actuates the user actuation handle 206 in a lateral direction as shown by arrows 229. This causes lateral movement of arm 208, thereby resulting in peg 220 sliding in slot 216 and causing arm 218 to move. Movement of arm 218 causes movement of magnet 228, thereby resulting in movement of the doll's foot 30. The user can control the movement of the handle 206 and thus move the doll in a required manner and/or direction. For example, in FIG. 1 the figure illustrates, in solid line, the doll in an at rest configuration with no movement means acting thereon. The dotted outline of the doll and control means in FIG. 1 illustrates how movement of the magnet 228 to position 228' causes movement of foot 30 to foot position 30'.

A metal plate 230 is provided in the play area surface 6 underneath magnet 25 of foot 32. The magnet 25 is magnetically attracted to metal plate 230, thereby stabilising the doll 4 during movement of the other foot 30. As foot 30 is moved to foot position 30', leg 18 is caused to cross over in front of leg 20, thus giving the appearance of a dance step or similar.

Further objects can be located on the playbase to provide stability to the doll during movement thereof. For example, FIG. 3 illustrates an object depicting a gym exercise bar 232 comprising two upright members 234 and a horizontal bar 236 therebetween. The exercise bar 232 is made from metal which attracts magnets 25 in hands 26 and 28 of the doll 4 thereto.

In accordance with the present invention, some, or all of the article 4 is made from a one-piece flexible material, such as a plastic/rubber material known by the trade mark Kraton. Alternative materials can also be used to suit specific requirements, PVC being one such alternative. Any movement of one of the magnets 25 causes a portion of the article adjacent the magnet to move accordingly. It is likely that movement of one part of the article will result in further movement. For example, movement of magnet 25 in hand 26, causes movement of arm 22 due to the arm 22 being integral with hand 26 and the shoulder part of the body component and formed from said flexible material. In addition, depending on the degree of flexibility of the doll, movement of the arm 22 can also cause slight further flexing of all of the body component 16. This creates life like movement which increases the realism of the article to the user. In this manner, movement of the movement means can be used to provide a range of life like movements of the doll, thereby giving the appearance to a user that the doll is walking, dancing and/or the like. For example, in FIG. 1, the flexibility of the doll 4 allows leg 18 to cross over leg 20 which would not previously be possible with prior art articles.

Lateral motion of the arm 218 can also be provided by clockwork or electrical mechanisms which can be powered manually or by an electrical source. For example, a battery 238 can drive a motor which powers a series of cogs 240, thereby rotating a drive shaft 242, as shown in FIG. 3. Screw thread portion 244 on drive shaft 242 is caused to rotate, which drives the rotation of cog 226, as shown by arrow 228. Rotation of cog 226 causes lateral movement of arm 218. An on/off switch can be provided on or adjacent the toy to allow the motor to be moved between on/off conditions.

Regardless of whether or not the movement means are provided the flexible material has a degree of resilience such that upon the release or withdrawal of the movement means, the article returns to an at rest configuration thereby adding to the effectiveness and realism of the article.

FIG. 2 illustrates an example of a play area 102 according to an embodiment of the present invention. The play area 102 is in the form of a house comprising a floor surface 104, side walls, 106, 108, 110, a roof 112 and chimney 114. Windows 116 and 118 are provided in side walls 106, 108 respectively. In this example, one of the side walls 120 of the house is hingedly mounted to the floor surface 104, thereby allowing the wall to be moved from a closed position, where it forms a side wall of the house, to an open position, where the interior wall of the side wall forms an additional floor surface of the playbase, as shown by arrow 115.

Objects can be provided on the surface of the play area and the article 4 can interact with the same through user selective positioning. For example, objects in the form of an ironing board 122 and iron 124, a cot 126 and table 128 are provided on the play area. The objects can be fixed to the playbase via conventional securing means, such as clips, adhesive, screws and/or similar, or can also be movable and positionable with respect to the play area by providing magnets therein which are attracted to magnetically attractive material on the play area such as the floors, walls and the like.

In FIG. 2 movement means in the form of movable arms 130, 132 are provided on the exterior surfaces of side walls 106 and 110 respectively. The arms 130, 132 can be moved in a forwards and backwards direction, as shown by arrow 134, or can be rotated in a clockwise and/or anticlockwise direction, as shown by arrow 136, to impart reciprocal motion of the objects connected thereto. Thus rotation of arm 132 causes the cot 126 to rock backwards and forwards and movement of arm 130 causes the iron 124 to move backwards and forwards along ironing board 122.

The iron 124 and the sides of the cot 126 are made from magnetic material, such as metal. The magnets 25 in the dolls' hands 26, 28 are attracted to the magnetic surface of the cot and/or iron. Due to the flexibility of the doll, if the doll is magnetically located on the iron or cot, typically via the magnet 25 at the hand component, movement of the iron or cot imparts movement of the hand and arm of the doll, thereby providing the appearance to the user that the doll is rocking the cot, or is ironing. The flexibility of the body components of the doll allow the body components to move without the doll toppling over. This is largely due to the positioning of the magnets such that the feet or base of the article are magnetically attracted to the floor.

A range of objects can be provided on the playbase to impart similar or different types of movement to those described above. For example, table 128 can be provided with a rotatably mounted metallic top. Thus when a part of the doll containing a magnet, such as a hand 26 or 28, is located adjacent the table 128, the hand is magnetically attracted to the table and engages therewith. Rotation of the table top, as shown by arrow 138, using control means (not shown) causes the dolls hand 26 or 28, arm and body portion to flex in the direction of movement of the table top. This gives the appearance of the doll rotating the table. The flexibility of the doll allows the feet of the doll to remain in position on the metal playbase during rotation of the table, even though the dolls hand, arm and/or upper body are moving with the table.

In an alternative embodiment, control means can be used to control movement of the doll, which then imparts movement to the object or other article.

The article 4 can be provided with other items attached thereto which are integrally or non-integrally formed therewith, such as clothes, hair, shoes, handbag and/or the like. These items add to the visual appearance of the doll to improve the realism of the toy. In addition to these items, the magnets provided in the hands or other parts of the article allow interaction with other similar articles such that, for example, multiple articles can be joined together via the common parts of the articles by magnetic attraction so as to give, for example, the appearance of the articles holding hands.

It is also possible that the magnets can be located in the article to allow the article to deposit specific features, for example the article can depict an athlete, fireman, or the like and the magnets can be positioned to allow predetermined actions, to be performed such as crouching at the start of a race, going up a ladder with a fire hose or the like.

The plastics material from which the doll is made typically has a shore hardness within the range of 25–30.

Figure 4:
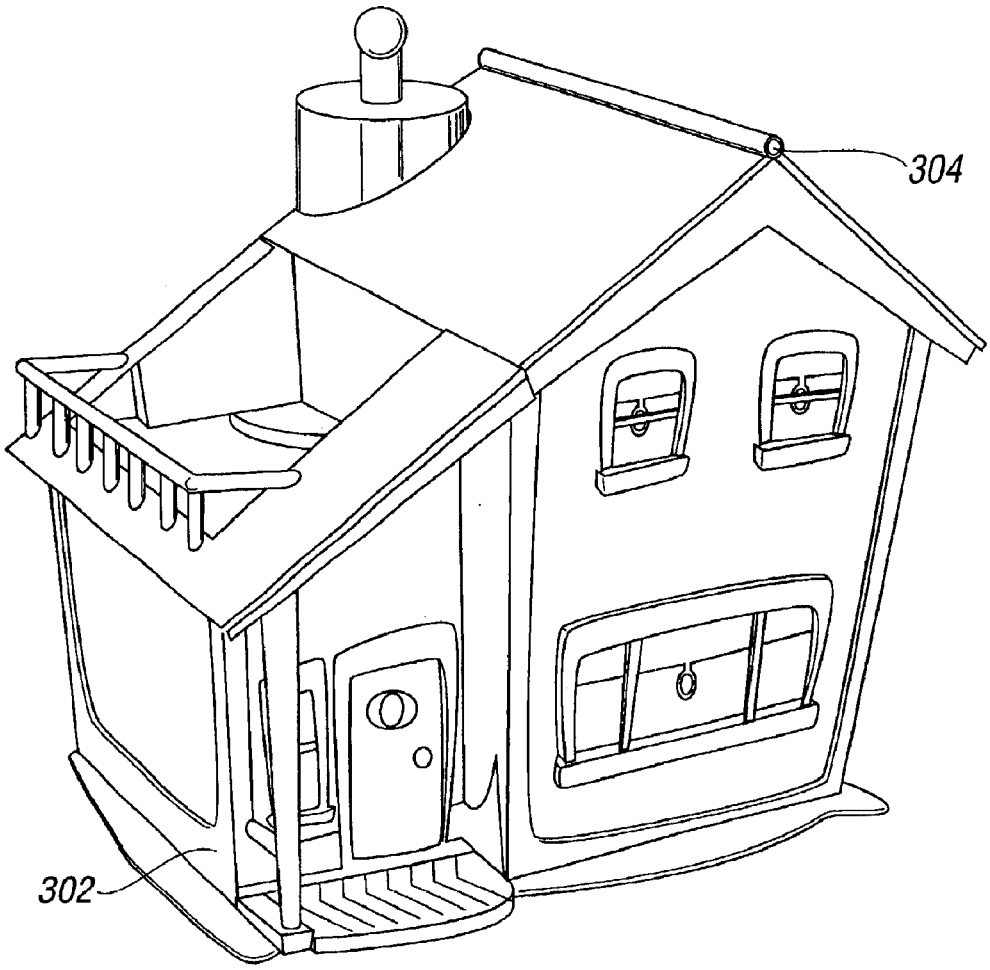
FIG. 4 illustrates a toy in accordance with one embodiment of the invention, in a closed condition.
Figure 5:
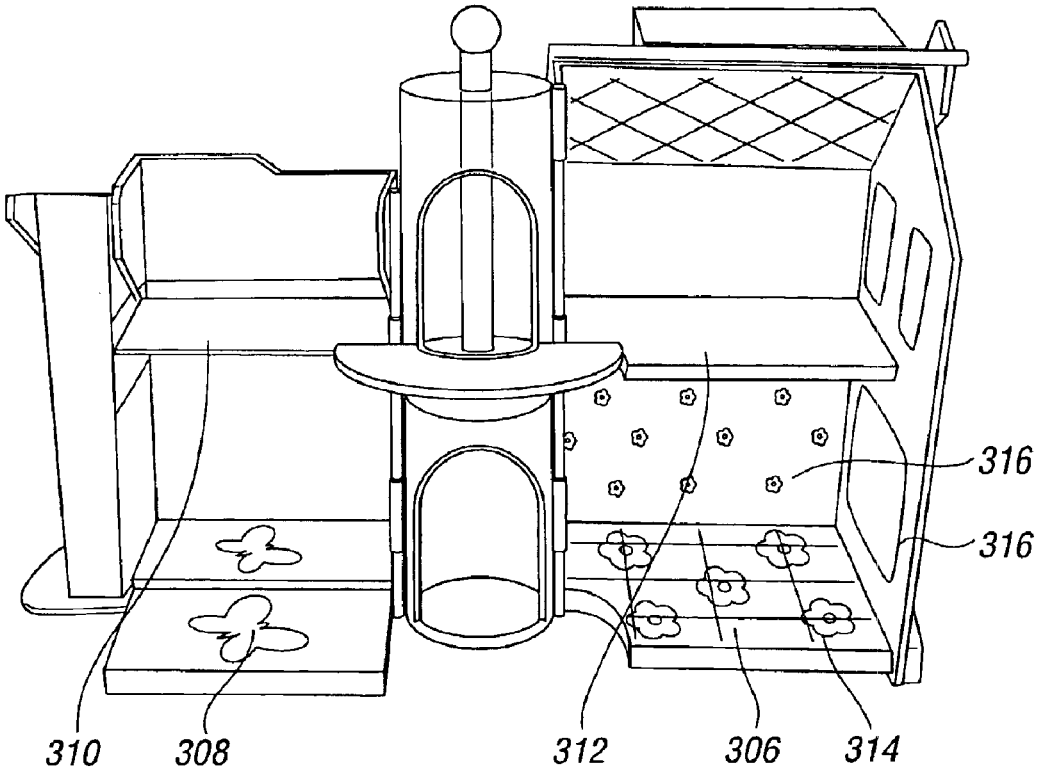
FIG. 5 illustrates the toy of FIG. 4 in an open condition for play.

FIG. 4 illustrates a further embodiment of a toy according to the invention wherein the toy depicts a model house 302 which can be moved from a closed position in FIG. 4 to an open position shown in FIG. 5 via movement of a number of hinged sections such as, for example, hinged section 304. The child, upon commencing to play with the toy, can therefore move the toy to the open condition as shown in FIG. 5 which exposes a number of play areas 306, 308, 310, 312. In accordance with this embodiment, each of the play areas includes a base 314 and walls 316. Each base, and preferably wall, of each of the play areas 306, 308, 310, 312 is provided with a layer of sheet material which is magnetically attractive, such as, for example, a layer of metal. The layer can be used to form the external surface of the base or wall or alternatively, can be positioned underneath an external layer so that additional decorative features can be incorporated while ensuring that the magnetic attraction is still possible.

It is also possible, although not shown in this embodiment, for selected portions of the base or walls to be formed with the magnetically attractive material so as to define portions within the play area in which articles in accordance with the invention can be retained in position.

Figure 6:
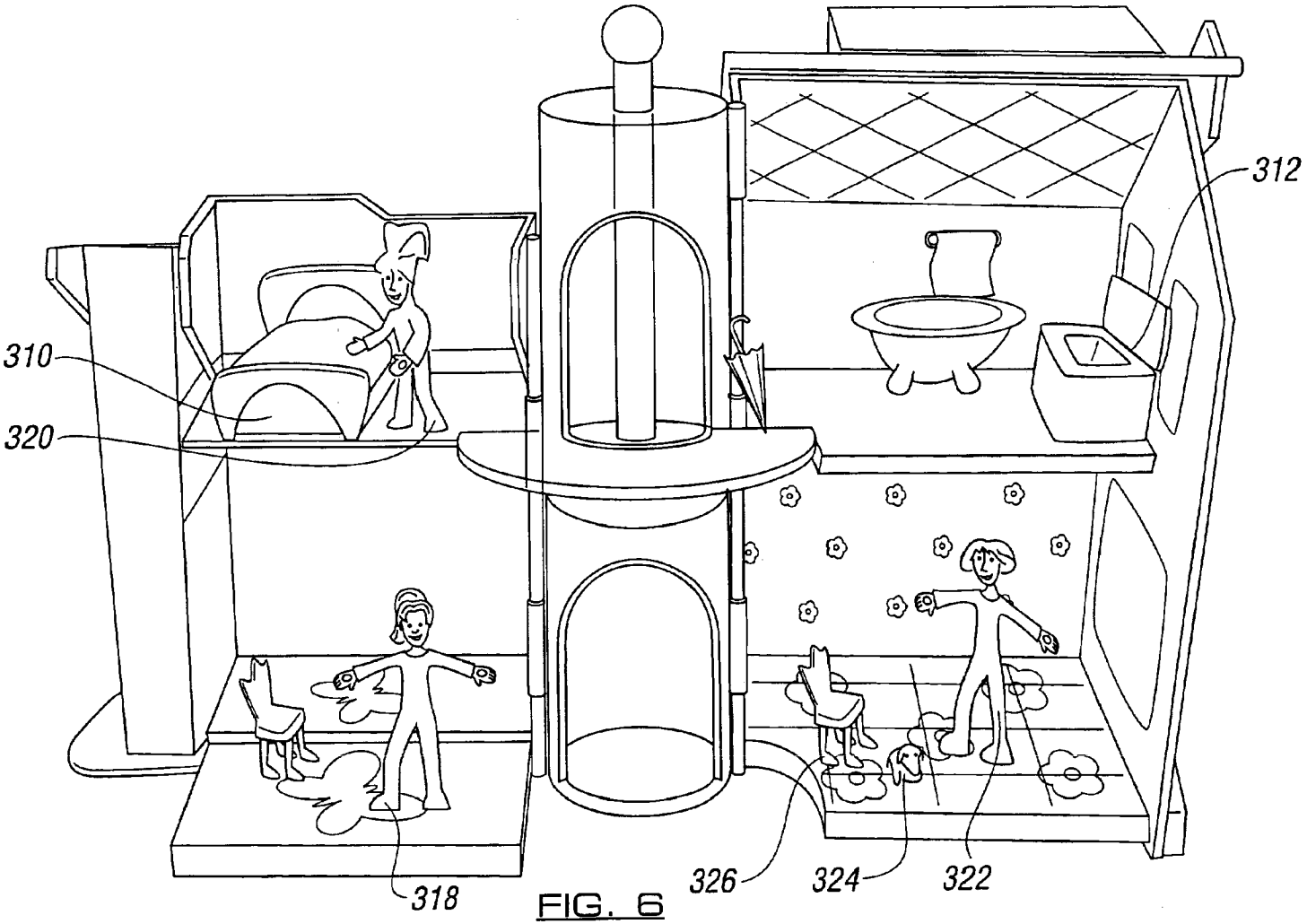
FIG. 6 illustrates the toy in an open condition as shown in FIG. 5 with articles and objects positioned in the play areas of the toy.

FIG. 6 illustrates the toy in an open condition with articles and objects selectively positioned and retained in position by magnetic attraction between magnets provided in the articles and objects and the magnetically attractive material of the walls and floors. Thus, in this embodiment, the articles comprise human characters 318, 320, 322; an animal 324 in the form of a dog and the objects are a series of items of furniture, one of which is indicated with a reference numeral 326, each of which can be selectively positioned. The items of furniture 326 can be selectively positioned in the appropriate play area so as to create a particular environment for that play area such as, for example, the bathroom in play area 312, bedroom in play area 310 and so on.

It will be appreciated that the present improvement allows a child to position and retain in that position various objects in a toy play area so as to define and create a particular play environment for that area and then play with the flexible articles in the play areas. Because of the magnetic attraction between the article and the play area, no protrusion and/or recesses are required to be formed on the play surface for location purposes and the same can be smooth, thereby allowing the user to place the article in position on magnetically attractive material in any of a plurality of selected positions. Thus the child is not restricted by particular engagement formations or other engagement means, and can also have articles interacting with other articles and/or objects due to magnetic attraction between the same. In this embodiment no movement means are provided with the user able to position the objects on the play area and select the location and position of the flexible material articles by selective positioning of the magnets in the article with respect to the play areas magnetically attractive material.

Figure 7:
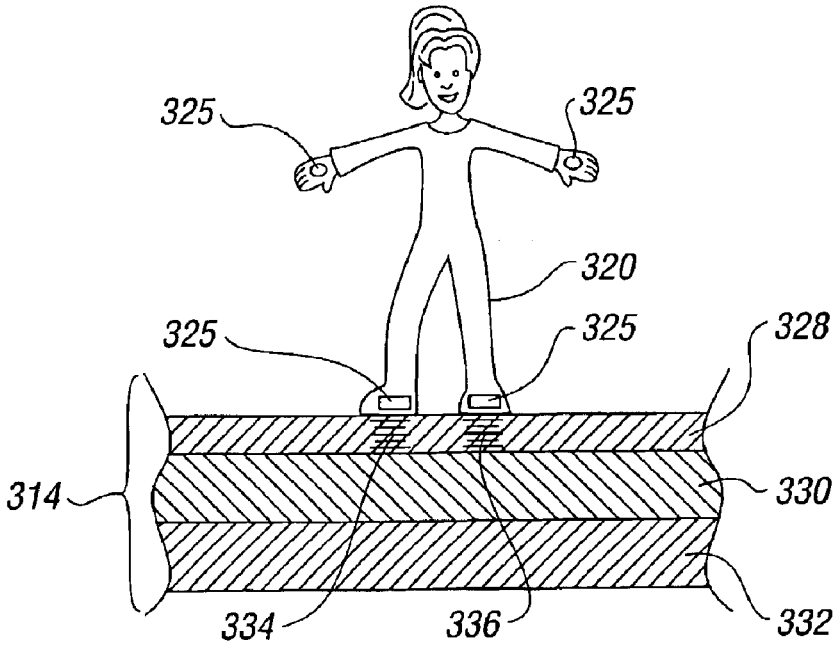
FIG. 7 illustrates a cross section through a play area base of FIGS. 4–6.

FIG. 7 illustrates a cross section through part of the base 314 of the play area of FIGS. 5 and 6 and illustrates how the base is made from a supporting layer 332, a magnetically attractive layer 330, such as a layer of metal, and an external, decorative surface 328. The decorative surface can be made of any material so long as it allows the magnetic fields 334, 336 created between the magnets 325 in the article 320 and the layer 330 to be maintained with sufficient strength so as to allow the positioning and retention of the article 320 by the magnetic fields as shown on the external surface. Typically the strength of the magnetic fields will be such so as to allow retention but also allow the child to pick up the article and move the same to another location as required. The arrangement can also be followed with magnets 325 in the hands or other portions of the character which can be placed adjacent the base or the walls of the play are a with the flexibility of the article allowing the same to move and be retained in positions selected by the child via the magnetic attraction.

Thus the present invention provides an improved toy which allows one or more articles located on a playbase to undertake more realistic "life like" movements due to the flexibility of the body components of the articles.

What is claimed is:

1. A toy including at least one article for location on and movement around a play base, said article having magnetically attractive means provided therein, movement means external to said article having further magnetically attractive means such that actuation of said movement means when magnetically close to the article exerts a moving force on the article and vice versa being caused by magnetic attraction between said article magnetically attractive means and said further magnetically attractive means and wherein said article is formed at least partially from substantially flexible material such that the moving force exerted on the article causes at least a part of said article to flex and move in response to the moving force.

2. A toy according to claim 1 characterised in that the article is wholly made from a flexible material.

3. A toy according to claim 1 wherein the article is provided with an outer skin of flexible material.

4. A toy according to claim 1 characterised in that the toy is provided as a one-piece item.

5. A toy according to claim 1 wherein the moving force exerted by the movement means on said article causes first movement in a first portion of said article adjacent said magnetically attractive means of said article and said first movement results in movement of at least a second portion of the article caused by the flexing of the material forming the article.

6. A toy according to claim 1 wherein the movement exerted causes rotation and change in size of the article.

7. A toy according to claim 1 wherein the flexible material has a degree of resilience so as to return to an at rest configuration once the moving force has been removed.

8. A toy according to claim 7 characterised in that the flexible material has a shore hardness of 20–40.

9. A toy according to claim 1 characterised in that the article is shaped as a person, animal, robot, cartoon character, or fictitious creature.

10. A toy according to claim 1 wherein the play base is provided for location of one or more objects thereon in addition to the article.

11. A toy according to claim 10 wherein the objects are connected to movement means by which the objects can be moved relative to the play base.

12. A toy according to claim 10 wherein the objects are made from metal or include magnetic material therein and magnetic means provided in the article are attracted to the objects.

13. A toy according to claim 1 characterised in that the play base is made from metal or contains magnetic material therein to which the article is attracted.

14. A toy according to claim 1 wherein movement means are provided beneath the play base.

15. A toy according to claim 14 characterised in that the movement means are manipulated to attract and move the flexible material of the article with magnetic means provided therein.

16. A toy model article, said article having magnetically attractive means provided therein, said article provided for selective actuation via movement means with further magnetically attractive means external to said article and arrangeable with respect to a play area for the article such that actuation of said movement means exerts a moving force on said article caused by magnetic interaction and wherein at least a portion of the article is formed from a substantially flexible material, said portion having an at rest configuration and a movement configuration when acted on by the magnetic interaction between the article and movement means such that the moving force exerted on said article causes the flexible material of said article to move and when the moving force is removed the flexible material resiliently returns to the at rest configuration.

17. A toy, said toy including at least one play area and at least one article including at least a portion which is formed of flexible material for selective positioning with respect to the play area external to the article, said play area includes a component wherein at least portions of the component are formed from magnetically attractive material to which magnets mounted in the article are attracted so as to allow the selective positioning and retention of the article with respect to said portions of the component, and actuation of the component exerts a moving force on the article to cause at least a part of the article to flex and move in response to the moving force.

18. A toy according to claim 17 wherein said play area has walls and a base and characterised in that all of the walls and base of the play area may be formed of magnetically attractive material.

19. A toy article according to claim 17 wherein said play area has an external surface and the magnetically attractive material forms the external surface of the play area.

20. A toy article according to claim 17, wherein the magnetically attractive material is covered by an external sheet material which forms an external surface of the play area.

21. A toy according to claim 17 wherein a plurality of articles and objects are provided as part of the toy, and each provided with at least one magnet so as to allow the articles to be selectively positioned on the play area which includes the magnetically attractive material.

* * * * *